US005100060A

United States Patent [19]

Haferkorn

[11] Patent Number: 5,100,060

[45] Date of Patent: Mar. 31, 1992

[54] HVLP PAINT SPRAY GUN

[75] Inventor: Wolfgang Haferkorn, Frankfurt am Main, Fed. Rep. of Germany

[73] Assignee: Bersch & Fratscher GmbH, Karlstein am Main, Fed. Rep. of Germany

[21] Appl. No.: 588,598

[22] Filed: Sep. 26, 1990

[51] Int. Cl.[5] ..... B05B 7/32

[52] U.S. Cl. ..... 239/337; 239/365; 220/368; 137/209

[58] Field of Search ..... 239/337, 364, 365, 368, 239/318, 366, 367; 137/505.42, 587, 209; 220/368, 89.1, 204; 285/239, 18

[56] References Cited

U.S. PATENT DOCUMENTS

| | | | |
|---|---|---|---|
| 584,864 | 6/1897 | Fisher | 239/365 |
| 1,166,059 | 9/1915 | Ledbetter | 285/239 |
| 1,498,728 | 6/1924 | Hill | 220/368 |
| 1,986,444 | 1/1935 | MacIntosh | 239/367 |
| 2,052,362 | 8/1936 | Roselund | 239/366 |
| 2,805,088 | 9/1957 | Cline et al. | 285/239 |
| 2,816,682 | 12/1957 | Brucker | 220/203 |
| 2,860,811 | 11/1958 | Hessler | 220/203 |
| 3,191,869 | 6/1965 | Gilmour | 239/348 X |
| 3,926,208 | 12/1975 | Hoffman et al. | 137/505.42 X |
| 4,469,237 | 9/1984 | Zeridan et al. | 220/203 X |
| 4,940,185 | 7/1990 | Fu | 239/347 X |

*Primary Examiner*—Andres Kashnikow
*Assistant Examiner*—Kevin Weldon
*Attorney, Agent, or Firm*—Trexler, Bushnell, Giangiorgi & Blackstone Ltd.

[57] ABSTRACT

A low pressure liquid spray gun including a gun body having a spray nozzle, a gas inlet connectable to a pressurized gas source and a reservoir for holding liquid. The gun body includes a material connector for directing the liquid out of the reservoir through the spray nozzle and a gas line for directing the gas from the inlet to the nozzle through the gun body. The gas line includes a control valve, a pressure reducing throttle positioned between the control valve and the nozzle, and a branch line connected with the gas line between the nozzle and the throttle. A pressure regulator is connected to the branch line for maintaining the air pressure in the reservoir.

23 Claims, 3 Drawing Sheets

HVLP PAINT SPRAY GUN

Figure 1:
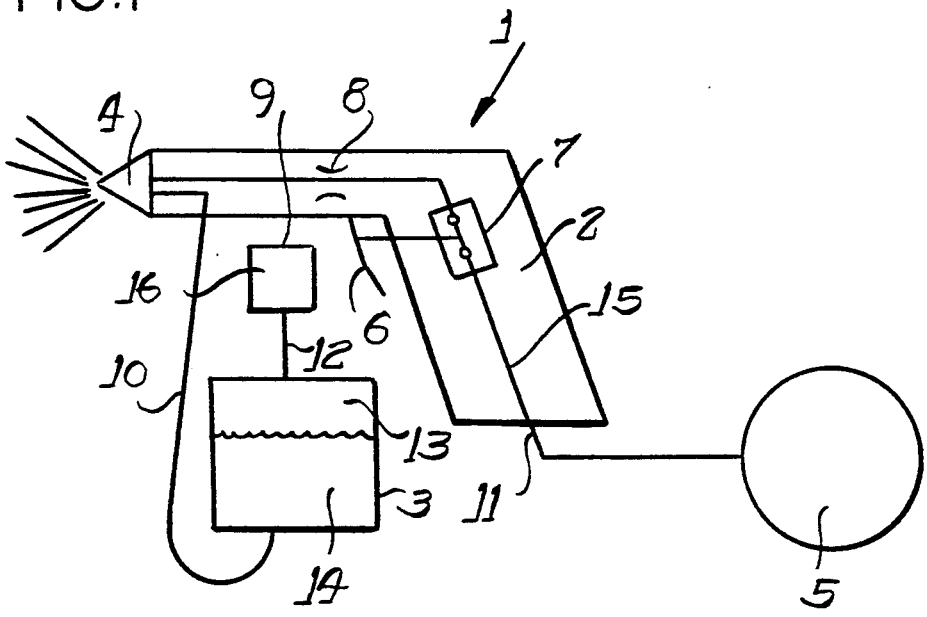

This new design represents a low pressure paint spray gun with a reservoir for the material to be used, a spray nozzle receiving the material from the reservoir through a pressurized line, a connection for the pressurized gas, a pressure reducing device between pressure connection and spray nozzle, a pressurized line taking pressurized gas from a section of the system between the pressure reducing device and the spray nozzle, discharging it into the reservoir, and a control device for opening or closing the gas supply stream.

Low pressure (HVLP) paint spray guns are gaining in importance since they spray with less fog or overspray then conventional high pressure guns. Those are guns operating with a pressure of 60 psig to 120 psig. The fog or overspray created by the high pressure gun is distributed freely into the room, which affects the operating personnel, and leads to environmental contamination. Normally compressed air is used as a propellant.

As a result of the much lower air pressure, compared to a high pressure spray gun, the leaving air velocity at the spray nozzle is much lower, creating a relatively low vacuum at the paint nozzle. The resulting vacuum is insufficient to transport paint or other material from the reservoir to the nozzle. Therefore the reservoir has been pressurized with the same air pressure present at the spray nozzle. This pressure acts upon the material in the reservoir and forces it through the material line to the spray nozzle.

The reduction of the line pressure in the pressure reducing device is normally a dynamic process, that is, it is depending upon the volume of the pressurized gas stream. In the simplest case the pressure reducing device is a throttle or orifice. With an increase of the pressurized gas flow the pressure drop through the orifice increases. Conversely, a reduced gas flow caused by a clogged air nozzle results in a very low or no pressure loss. In this case the pressures upstream or downstream of the pressure reducing device are equal. This high pressure will also be found in the reservoir. Generally the reservoir is not designed for these high pressures. In extreme cases the reservoir may explode or may separate from the gun.

Aside from the fact that the content of the reservoir will soil the immediate area, the explosion or separation of the reservoir is dangerous since uncontrolled parts projectiles may injure operating personnel.

It is therfore the intent of this new design to present a paint spray gun that is safe in its operation.

In a low pressure (HVLP) spray gun as described above the problem has been solved in that a pressure limiting device has been incorporated that will maintain the pressure in the reservoir within safe limits.

This predetermined pressure can be selected so that the vessel will be safe in any case. Even with a clogged air nozzle unsafe conditions will not develop. The pressure limiting feature is controlling only the reservoir and directly connected passages. It is not limiting pressure in the spray nozzle. Therefore, full pressure is available at the spray nozzle, making it possible to dislodge any material that may have clogges the nozzle. The advantage of the dynamic pressure reduction can be used without creating dangerously high pressure in the reservoir.

In the preferred design the pressure limiting device is a pressure regulator. With this the pressure is regulated as well as maintained at a constant level.

Even supply pressure variations, or pressure changes due to variations in air demand of the gun, will not result in pressure changes in the reservoir. Therefore, the material to be sprayed will be supplied with constant pressure, which will improve the quality of the coating. The pressure regulator maintains the pressure in the reservoir at a considerably lower level then at the spray nozzle. The pressure in the reservoir merely has to convey the material to the spray nozzle. An increased pressure leads to an increased supply stream. This increase has to be throttled in order to achieve the right ratio of compressed air and material. It is sufficient when the pressure in the reservoir is held at one tenth to one half of the pressure at the spray nozzle.

In the preferred design the reservoir pressure is adjustable. The pressure than will match the different properties of the material to be sprayed. A material with a high viscosity requires a pressure different from that used for a low viscosity material. In addition, it is possible to change the ratio of gas flow to material flow by adjusting the pressure. In some cases it may be necessary to increase the gas flow, whereas in other cases it may be desirable to increase the material flow. By adjusting the pressure numerous applications can be satisfied. The adjusted pressure remains constant in any case. This prevents dangerous increases of the pressure in the reservoir, while the material transfer to the spray nozzle remains constant. This enables the operator to paint without problems once the pressure has been adjusted, thereby creating a high quality finish.

It is preferred that the pressure regulator is equipped with a diaphragm, pressurized on one side by the pressurized gas, and on the other side balanced by spring pressure, whereby the diaphragm acts upon a valve opening or closing the pressure supply line to the diaphragm. The pressure of the gas, as an example compressed air, acts upon one side of the diaphragm, displacing it against the force of the spring. The diaphragm thereby moves the valve toward the fully closed position. No additional pressurized gas will reach the diaphragm. At this point gas pressure under the diaphragm and spring pressure are balanced. Diminishing pressure under the diaphragm causes the spring to move the diaphragm and the valve toward the open position. The changing forces allow valve movement from open to closed position so that a regulated outlet pressure is finally reached.

With material flowing from the reservoir a certain gas flow is established that will maintain a small opening between valve and valve seat, resulting in a throttling effect and establishing the desired pressure in the reservoir.

Of advantage would be an adjusting screw that puts the spring under compression. An increase in spring pressure requires a higher gas pressure to move the valve toward the closed position. If the adjustment screw decreases the spring pressure a lower gas pressure is sufficient to displace the diaphragm so that the valve moves to a closed position.

In another preferred design a pressure relief valve is combined with the pressure regulator. The relief valve allows gas to vent from the reservoir if the pressure in the reservoir rises above a preselected level.

It is advantageous to locate the pressure relief valve on the low pressure side of the pressure regulator. This, in addition to the pressure regulator, provides an added measure of safety. In the event of a failure of the pressure regulator, resulting in full line pressure on the low pressure side of the regulator, the relief valve prevents unsafe pressure increases in the reservoir.

A preferred design makes the relief valve an integral part of the pressure regulator. No additional space is required for the relief valve. Manufacturing becomes relatively easy.

In another preferred design there is a pressure line leading to the reservoir using a small diameter plastic hose pushed onto a hose barb at the regulator outlet. If the pressure increases above a preselected level the hose will be blown off the hose barb. Under normal operating conditions the hose is held on the hose barb by its own elasticity. The power holding it on the barb is the result of friction and is sufficient to balance the force caused by the gas pressure in the reservoir. The pressure in the vessel attempts to increase the enclosed volume. If the pressure in the reservoir exceeds a preselected level the blow-off force becomes greater than the holding power and the hose is blown of the barb. The gas will escape and the pressure is relieved instantly.

In another preferred design the reservoir is connected to the spray gun body by a bracket, formed like a stirrup, holding the lid of the reservoir in place. This bracket will deform under excessive pressure in the reservoir, opening a small gap between lid and reservoir body.

Elastic deformation of the bracket will allow reseating of the lid after relief of the overpressure with possible repeated pressure increase. It is also possible to design the bracket in such a way that the gap between lid and reservoir body remains open. Since the occurrence of such an overpressure is generally the result of a serious mistake or defect, above permanent deformation has the advantage that the operator has to inspect the spray gun very carefully, looking for possible defects, before resuming operation.

It is also preferred to have a safety catch for the reservoir incorporated that will hold the reservoir if overpressure has caused a separation from the lid. If deformation of the bracket holding the reservoir has led to a gap between lid and body there is no assurance that the reservoir is still securely held in place. Under this condition sudden movement or bumping the reservoir could lead to total separation from the gun. Even low pressures acting upon the cross sectional area of the reservoir may result in forces propelling the vessel over some distance into the room. In order to prevent dangerous conditions for operators, or the surrounding area, the safety catch designed into the vessel will hold it safely if it ever separates from mounting bracket or lid. The safety catch will permit a movement of a fraction of an inch only.

The safety catch consists of two safety rails at the outer edge of the lid engaging a corresponding number of pins installed in the neck of the vessel. The pins engage the safety rails in the lid when the vessel is slightly twisted. This bayonet style engagement secures the vessel to the lid. The pins are not arrested in the grooves when the reservoir is turned through the limited angular movement since there is clearance between the wall of the grooves and the diameter of the pins. In case of separation of the vessel from lid or mounting bracket, the width of the grooves prevent excessive movement of the reservoir since the pins remain in contact with the grooves of the safety rails.

In another preferred design there is in the housing of the gun on the low pressure side, connected to the reservoir, an opening closed by a pressure plug where the friction force is lower then the force created by unsafe pressure in the reservoir. This overpressure safety device works similar to the previously mentioned hose. Exceeding the preset pressure on the low pressure side, that is when a dangerous condition develops, the plug is simply forced out of the opening. The gas can exhaust instantly and lower the pressure in the reservoir. As soon as the pressure has been relieved the operator can re-insert the plug.

It is preferred to provide a safety catch for the plug, thereby preventing the plug from endangering the operator. A suggested safety catch could be a net stretched across the opening. The plug could also be secured to the housing with a chain or cord preventing excessive movement of the plug.

The new design is shown in its preferred configuration in the following drawings:

FIG. 1 A schematic of the spray gun.

Figure 2:
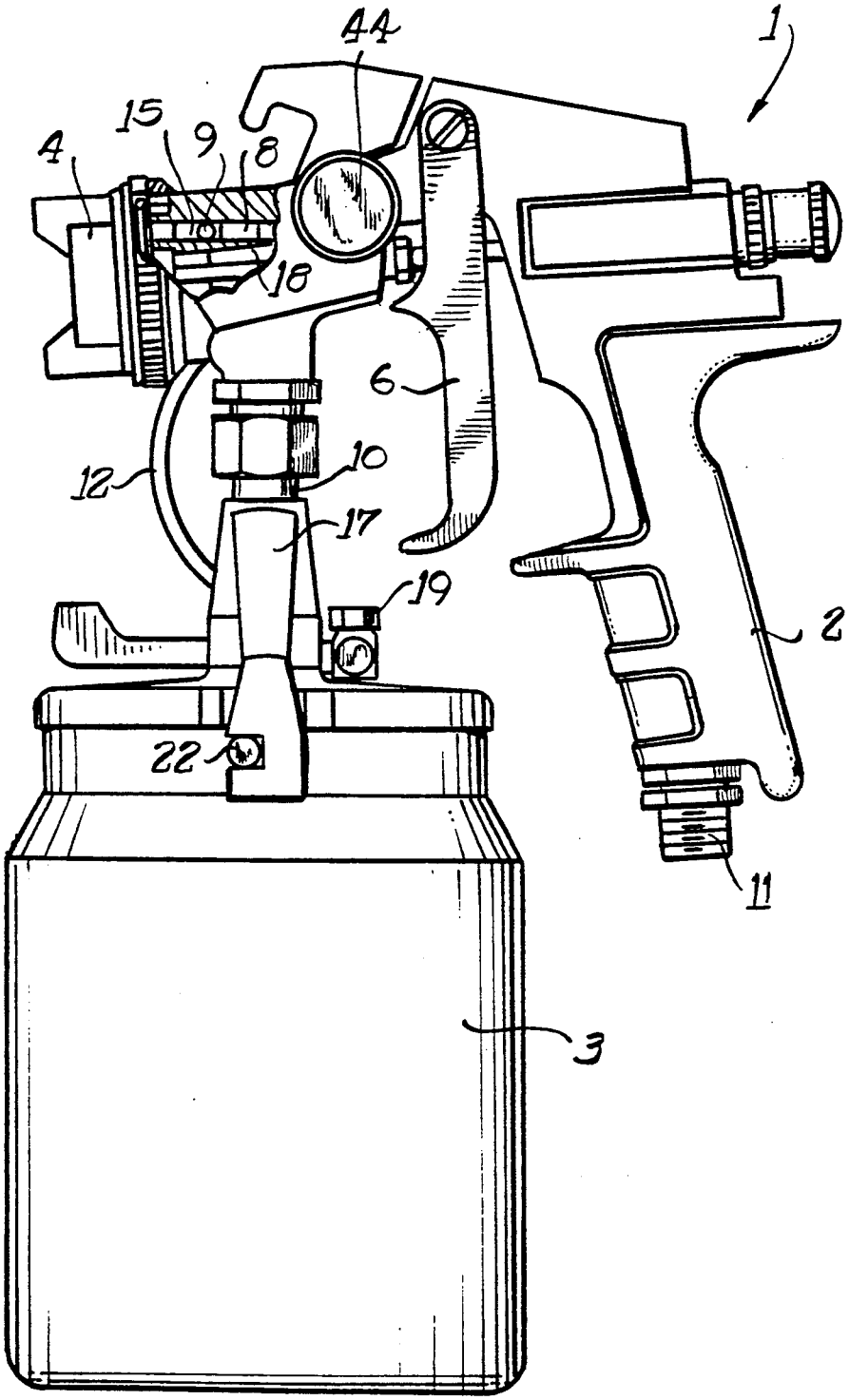

FIG. 2 A side view of the spray gun

Figure 3:
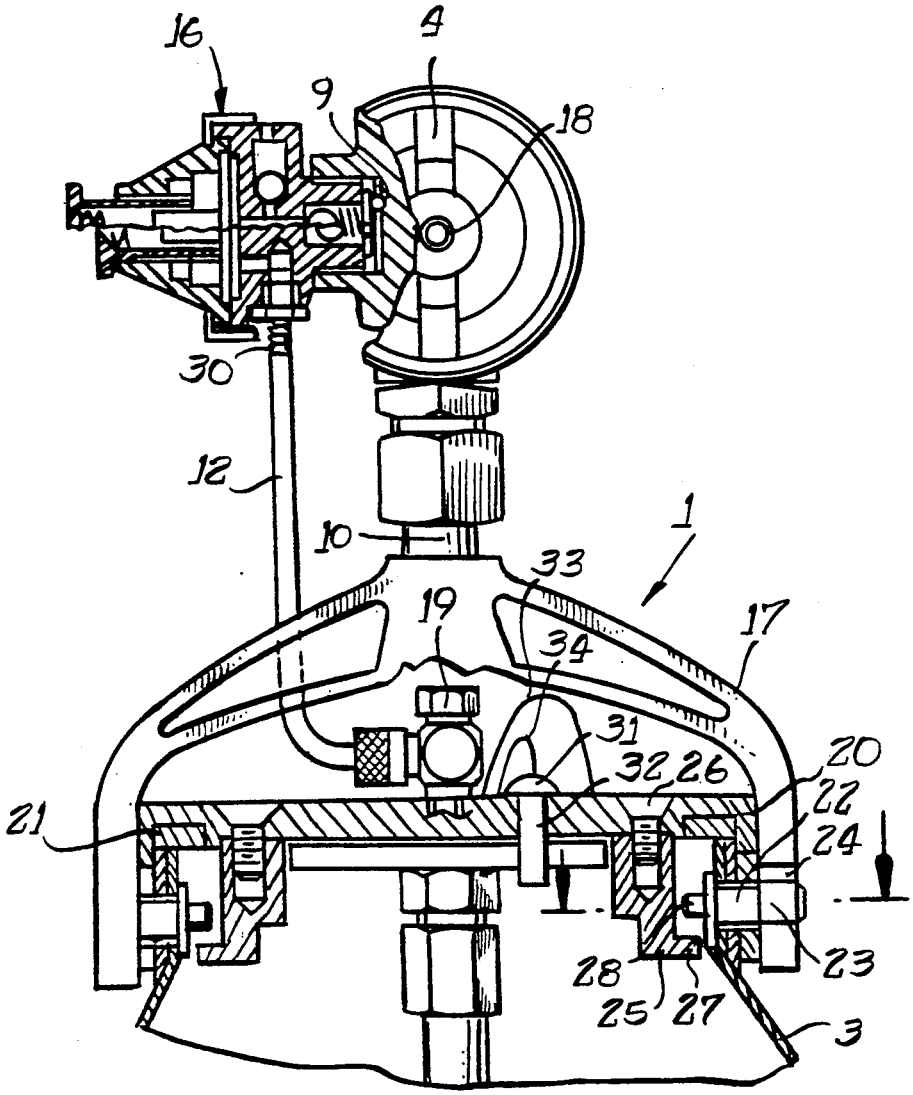

FIG. 3 A side view of the spray gun, rotated 90 deg.

Figure 4:
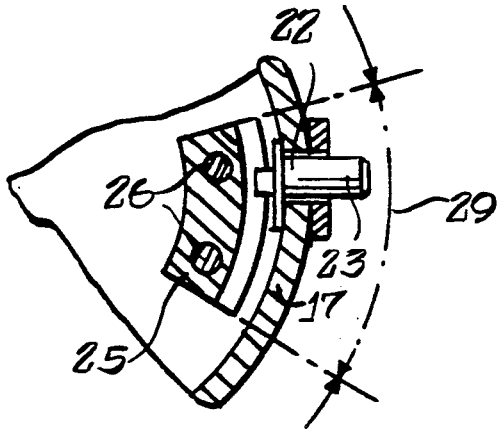

FIG. 4 A cross section IV—IV of FIG. 3

Figure 5:
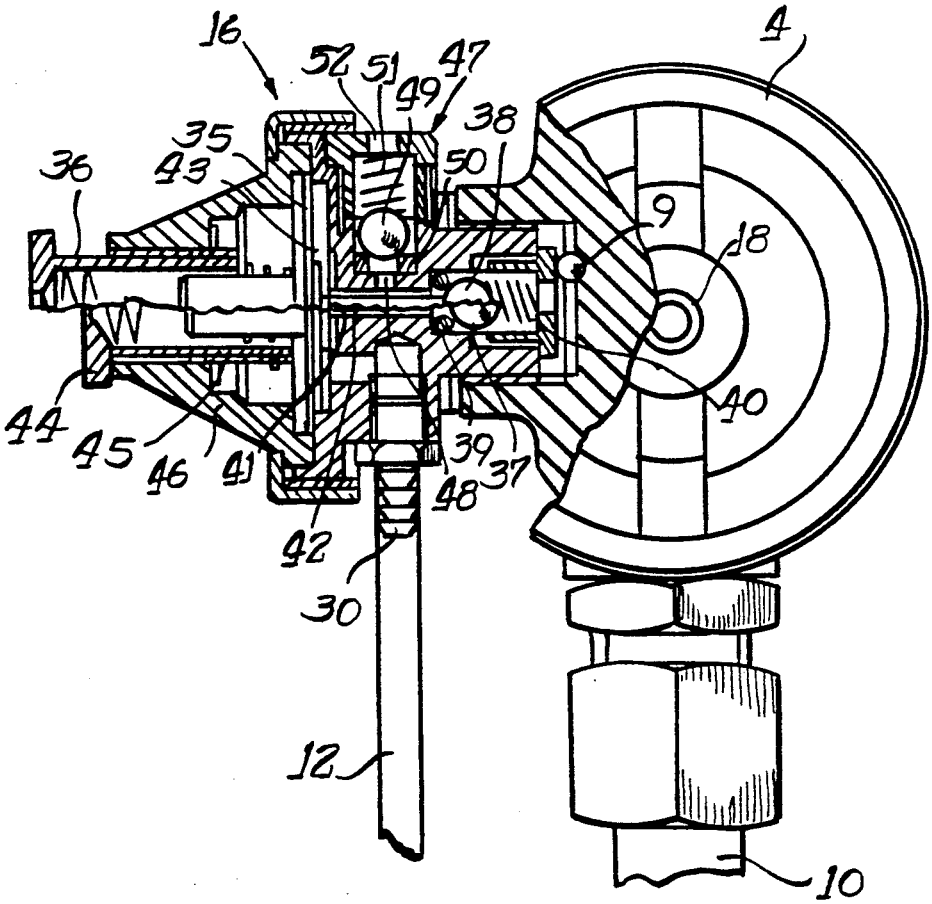

FIG. 5 A detail drawing based upon FIG. 3

FIG. 1: A spray gun (1) with a body (2) that is connected to a reservoir (3) and a spray nozzle (4). The reservoir (3) contains the material (14) and an air space (13) above it. The body (2) of the spray gun (1) has a compressed air connector (11) supplying compressed air from a source (5). Instead of compressed air another compressed gas can be used if that is necessary. A compressed air line (15) leads from the compressed air connector (11) to the spray nozzle (4). In order to control the air flow through line (15) a control device (7) is provided where a control lever (6) opens or closes the flow through line (15).

FIG. 1 shows a condition where the control device (7) has opened the passage for compressed air from connector (11) to nozzle (4). In the compressed air line (15) a throttle (8) has been installed that reduces the air pressure from the source (5) to a level suitable for the low pressure spray gun. The compressed air source generally provides a pressure ranging from 60 psig to 120 psig. At the spray nozzle pressures from 5 psig to 9 psig are desired.

Between throttle (8) and nozzle (4) there is a branch (9) from which a line (12) directs air pressure to the air space (13) of the reservoir (3). Between branch (9) and the reservoir (3) a pressure regulator (16) has been located. Pressure regulator (16) controls the pressure of the air space (13) of the reservoir (3), maintaining a constant pressure of approximately 0.4 psig to 4.4 psig. Regardless of the pressure at branch (9) the pressure in the reservoir (3) cannot exceed the pressure level selected at the pressure regulator (16). Dangerous situations caused by overpressure in the reservoir (3) are thereby practically impossible. The branch line (9) may see higher pressures since the throttle (8) will only reduce the line pressure from source (5) under certain flow rates.

If the spray nozzle (4) has been clogged, or is closed for tests by the operator, the full line pressure develops on either side of the throttle (8). This pressure cannot reach the reservoir (3) through the pressure regulator (16).

The pressure in the reservoir (3) transfers the material (14) through a material line (10) to the spray nozzle (4).

The pressure in the resevoir may be considerably lower than the pressure required at the spray nozzle (4) since it only has to transfer the material to the spray nozzle. When higher spray pressures are necessary the transfer results from the vacuum created at the spray nozzle. This is insufficient in the low pressure gun presented here. In addition to the line (10), shown as a hose in FIG. 1, the material line (10) can be a riser tube with a bottom opening in the reservoir (3).

The pressure from the pressure regulator (16) is adjustable. Thereby, the spray gun permits adaptation to different requirements. Variations of the viscosity of the material (14) can be handled. It is also possible to change the ratio of material to compressed air. An increase in pressure in the reservoir (3) transfers more material to the spray nozzle (4).

FIG. 2 shows a side view of the spray gun (1). Here the reservoir (3) is securely, yet removably, connected to the body (2) by a retaining bracket (17). Actual connection is achieved by a bayonet type latch. The material line (10) is, in this case, a riser tube and continues within the body (2) as a material channel (18). The air pressure line (12) is attached to the reservoir (3) by a hose connector (19). The line between compressed air source (5) and hose coupler (11) is not shown.

FIG. 3 shows a front view and partial cross section of the spray gun. The pressure regulator (16) is explained below and within FIG. 5. The reservoir has a lid (20). A seal (21) is placed between the neck of the reservoir (3) and lid (20). The reservoir (3) is held in contact with the lid (20) by mounting bracket (17). The riser tube of the material line (10) is centrally located in the lid (20). The air pressure connector (19) passes also through the lid.

To hold the reservoir (3) against the lid a number of pins (22) are spaced around the circumference of the neck of the reservoir, engaging with their outer end (23) the hooks (24) of the mounting bracket (17). Each pin (22) on the inside of the neck of the reservoir has a safety rail (25), fastened to the lid with screws (26).

The rail has a ledge (27) engaging the inner end (28) of pin (22). Under normal conditions, that is when the reservoir has been correctly attached, pin (22) is not in contact with safety rail (25). Between inner end (28) of pin (22) and ledge (27) there is normally a space of several millimeters ranging from 0.5 mm to 3 mm. The desired space is about 1 mm to 2 mm. The safety rails are spaced uniformly around the circumference of the lid, and have gaps between them of at least the diameter of the inner end (28) of pin (22). To install the reservoir (3) the inner ends (28) of the pins (22) enter the gaps between the safety rails. The resevoir is twisted about its axis through a predetermined angle. The inner ends (28) of the pins (22) then engage the ledge (27) of the safety rails (25). The length of the safety rail (25) establishes a safety area (29). In case of a pressure increase in the reservoir (3), resulting in a gap between lid (20) and reservoir (3), separating the reservoir (3) from the retaining bracket (17), the safety rails prevent additional movement of the reservoir (3) since the inner ends (28) of the pins (22) remain above the ledge (27), thereby blocking any movement of the reservoir (3). In order to remove the reservoir (3) the pins (22) have to be disengaged from the safety area (29). Removal of the reservoir from the mounting bracket (17) is now possible.

The pressure line (12) is a hose pushed onto a hose barb (30) at the pressure regulator (16). It is held on the hose barb (30) by friction. The friction force is larger than the force created by the pressure in the reservoir (3) so that the hose will not be pulled off the hose barb (30). However, pressure in the reservoir always attempts to increase it volume. If the pressure in the reservoir (3) increases above the design pressure the force acting upon the pressure line (12) will exceed the friction force and will pull the hose from the hose barb (30). As soon as the hose is pulled off, the air in the reservoir will escape. Since the hose barb (30) at the pressure regulator (16) is readily accessible the operator will simply push the hose back onto the barb (30) and will continue with the work.

An additional safety device is a plug (31), sealing an opening (32). The safety plug (31) is held in the opening by friction. Increase of the pressure in the reservoir (3) above the design pressure, increases the force acting upon the plug above the friction force. The plug (31) will be forced out of the opening (32). The compressed air can escape instantly, permitting an equivalent pressure reduction in the reservoir (3). A safety device to contain the plug (31) is either a net (33), or a chain or cord (34) connected to the plug (31) and lid (20).

When the pressure in the reservoir (3) has forced the safety plug (31) out of the opening (32) the net (33) or the chain (34) will contain it. It will remain in the area of the lid (20) so that nobody is endangered.

FIG. 5 shows the pressure regulator (16), previously shown in FIG. 3, in a larger scale. In the upper half of the drawing an adjustment is shown that would result in a low pressure in the reservoir (3). The lower half shows an adjustment permitting a higher pressure in the reservoir (3).

The pressure regulator (16) shows a diaphragm (35), acted upon by a spring (36) on the one side, and by air pressure, as it exists at branch line (9), on the other side. The spring (36) may have a backing plate acting upon the diaphragm (35). The air at branch line (9) must first pass through valve (37) that consists of valve seat (39) and valve plug (38). A valve spring (40) forces the valve plug (38) against seat (39). The valve plug (38) is forced off the valve seat (39) by a valve stem (41) connected to the diaphragm (35). The force of the spring (36) on the diaphragm (35) and stem (41) is greater then the force of spring (40) on valve plug (38) and stem (40). Therefore, the valve is open when there is no air pressure.

Pressure from branch line (9) enters valve (37), and through a channel (42), formed by the housing and stem (40), enters the diaphragma chamber (43), where the diaphragm is moved against the pressure of spring (36). Viewing the drawing, the diaphragm is moved against the force of the spring (36) toward the left. The other parts of valve (37) follow the movement to the left, and at the end of the stroke closes off the air passage between branch line (9) and the diaphragm chamber (43). Pressure in the diaphragm chamber (43) drops, and the spring (36) will move the diaphragm (35) to the right. At the same time the stem (41) is moving the valve plug (38) off the seat (39). In a balanced situation a cycling operation develops whereby valve (37) opens and closes in order to maintain the desired pressure in the diaphragm chamber (43), as well as in the pressure line (12), connected to the chamber (43). Under an adequate flow rate through pressure line (12) the valve (37) may also act as a throttling device, creating the desired pressure drop between branch line (9) and pressure line (12).

The tension of the spring (36) is adjustable by the screw (44) threaded into the housing (46) of the pressure regulator (16). The force of the spring (36) acting upon the diaphragm (35) increases as the adjustment screw (44) is threaded deeper into the housing (46).

There is a corresponding increase of the pressure required in the pressure chamber (43) to displace the diaphragm to the point that valve plug (38) of valve (37) is seated. Closing of valve (37) by the position of screw (44), as shown in the lower half of FIG. 5, results in a higher pressure then the position of screw (44) shown in the upper half of FIG. 5.

The pressure regulator (16) shows a pressure relief valve (47) where the inlet (48) comes from channel (42). A steel ball (49) is held in contact with valve seat (50) by a spring (51). If the pressure in the diaphragm chamber (43) rises above a preselected level the pressure in channel (42) will also rise. An increase of the force acting upon the steel ball (49), caused by the pressure increase in channel (42), will exceed the force from the spring (51), lifting the ball (49) off the seat (50), opening exhaust (52), and permitting the compressed air to escape. Exhausting the air will lower the pressure in the channel (42) and chamber (53) to the preselected level. Unsafe pressure increases downstream of the pressure regulator are thereby reliably prevented.

I claim:

1. A low pressure gun for spraying liquid under pressure, said spray gun comprising a gun body having a spray nozzle and a gas inlet connectable to a source of pressurized gas, a reservoir for holding said liquid releasably connected to the gun body, said gun body having a material connector for directing said liquid out of said reservoir through said spray nozzle and a gas line for directing said gas from the inlet to the nozzle through said gun body, said gas line including a control valve in said line for controlling said gas positioned between said inlet and said nozzle, and a pressure reducing throttle positioned between said control valve and said nozzle, a branch line connected with said gas line between said nozzle and said throttle and valve for directing gas to said reservoir; and a pressure regulator connected to said branch line for maintaining air pressure in said reservoir at a lower level than the pressure at said spray nozzle.

2. A spray gun of claim 1 wherein said pressure regulator is positioned between said gun body and said reservoir, and said pressure regulator includes a pressure hose for directing said gas into said reservoir.

3. A spray gun of claim 2 wherein said pressure regulator includes a diaphragm pressurized on one side by said gas exiting from said branch line and pressurized on another side by a spring member, wherein said diaphragm acts upon a valve for opening or closing said branch line for controlling said pressure of said gas.

4. A spray gun of claim 3 wherein the pressure of said pressure regulator is adjustable by an adjustment screw acting upon said spring.

5. A spray gun of claim 4, wherein said pressure hose is releasably attached to said pressure regulator by a hose barb, and said pressure hose can be blown off said hose barb when said pressure in said reservoir rises above a predetermined level.

6. A spray gun of claim 4, wherein said reservoir has a lid releasably connected thereto and means for detaching said lid from said reservoir when said pressure in said reservoir rises above a predetermined level.

7. A spray gun of claim 6, wherein said reservoir includes a securing member for holding said reservoir to said gun body after said lid is detached due to said over-pressure in said reservoir.

8. A spray gun of claim 4, wherein said reservoir includes an opening in said lid and a plug releasably held in said opening by friction, wherein an increase of pressure in said reservoir above a predetermined level increases the force acting upon said plug above the friction force, forcing out said plug from said opening, thereby allowing the compressed air to escape, permitting an equivalent pressure reduction in said reservoir.

9. A spray gun of claim 8, wherein said plug is releasably connected to said reservoir by a retaining member.

10. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozzle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, and said pressure regulator being positioned between said gun body and said reservoir and having a pressure hose for directing said pressurized gas to said reservoir.

11. A spray gun of claim 10 wherein said pressure regulator includes a diaphragm pressurized on one side by said gas exiting from said branch line and pressurized on another side by a spring member, wherein said diaphragm acts upon a valve in said pressure regulator for opening or closing said branch line, thereby controlling the pressure of said gas.

12. A spray gun of claim 10 wherein said pressure of said pressure regulator is adjustable by an adjustment screw acting upon said spring.

13. A spray gun of claim 12 wherein said pressure hose is attached to said pressure regulator by a hose barb and said pressure hose may be blown off said hose barb once the pressure inside the reservoir rises above a predetermined level.

14. A spray gun of claim 13 wherein said reservoir has a lid releasably connected thereto and means for detaching said lid from said reservoir when said pressure in said reservoir rises above a predetermined level for releasing said gas from said reservoir when said pressure in said reservoir has succeeded a predetermined level.

15. A spray gun of claim 14 wherein said reservoir includes securing members for holding said reservoir to said gun body after said lid is detached due to said over-pressure.

16. A spray gun of claim 14 wherein said reservoir includes an opening in said lid and a safety plug releasably held in said opening by friction, wherein an increase in pressure in said reservoir above a predetermined level increases said force acting upon said plug above said friction force so that said plug will be forced out of said opening thereby allowing the compressed gas to escape, permitting an equivalent pressure reduction in said reservoir.

17. A spray gun of claim 16 wherein said plug is releasably connected to said reservoir by a retaining member.

18. A low pressure gun for spraying liquid under pressure, said gun comprising a gun body having a spray nozzle and a gas inlet connectable to a source of pressurized gas, a reservoir for holding said liquid releasably connected to the gun body, said gun body having a material connector for directing said liquid out of said reservoir through said spray nozzle and a gas line for directing said gas from the inlet to the nozzle through said gun body, said gas line including a control valve in said line for controlling said gas positioned between said inlet and said nozzle, and a pressure reducing throttle positioned between said inlet and said nozzle, a branch line connected with said gas line between said nozzle and said throttle and a valve for directing gas to said reservoir; and a pressure regulator connected to said branch line for maintaining air pressure in said reservoir at a lower level than the pressure at said spray nozzle, said pressure regulator being positioned between said gun body and said reservoir, said pressure regulator including a pressure hose for directing said gas into said reservoir, said pressure hose being releasably attached to said pressure regulator by a hose barb and said pressure hose being blown off said hose barb when said pressure in said reservoir rises above a predetermined level; said pressure regulator including a diaphragm pressurized on one side by said gas exiting from said branch line and pressurized on another side by a spring member, said diaphragm acting upon a valve for opening or closing said branch line for controlling said pressure of said gas and said pressure of said pressure regulator adjustable by an adjustment screw acting upon said spring.

19. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozzle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, said pressure regulator being positioned between said gun body and said reservoir and having a pressure hose for directing said pressurized gas to said reservoir, said pressure hose being attached to said pressure regulator by a hose barb and said pressure hose being blown off said hose barb after said pressure inside said reservoir rises above a predetermined level, said pressure regulator including a diaphragm pressurized on one side by said gas exiting from said branch line and pressurized on another side by a spring member, said diaphragm acting upon a valve in said pressure regulator for opening or closing said branch line thereby controlling the pressure of said gas and said pressure of said pressure regulator being adjustable by an adjustment screw acting upon said spring.

20. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, said pressure regulator being positioned between said gun body and said reservoir and having a lid releasably attached thereto and a pressure hose for directing said pressurized gas to said reservoir, said pressure hose being attached to said pressure regulator by a hose barb and said pressure hose being blown off said hose barb once said pressure inside said reservoir rises above a predetermined level, said pressure regulator including a diaphragm pressurized on one side by said gas exiting from said branch line and pressurized on another side by a spring member, said diaphragm acting upon a valve in said pressure regulator for opening or closing said branch line thereby controlling said pressure of said gas and said pressure of said pressure regulator being adjustable by an adjustment screw acting upon said spring, said reservoir having means for detaching said lid from said reservoir when said pressure in said reservoir rises above a predetermined level for releasing said gas from said reservoir when said pressure in said reservoir succeeds a predetermined level.

21. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozzle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, said pressure regulator being positioned between said gun body and said reservoir and having a lid releasably attached thereto and a pressure hose for directing said pressurized gas to said reservoir, said pressure hose being attached to said pressure regulator by a hose barb and said pressure hose being blown off said hose barb after said pressure inside said reservoir rises above a predetermined level, said pressure regulator including a diaphragm pressurized on one side by said gas exiting from said branch line and pressurized on another side by a spring member, said diaphragm acting upon a valve in said pressure regulator for opening or closing said branch line thereby controlling said pressure of said gas and said pressure of said pressure regulator being adjustable by an adjustment screw acting upon said spring, said reservoir having means for detaching said lid from said reservoir when said pressure in said reservoir rises above a predetermined level for releasing said gas from said reservoir when said pressure in said reservoir succeeds a predetermined level and said reservoir including securing members for holding said reservoir to said gun body upon detachment of said lid due to said over-pressure.

22. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozzle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, said pressure regulator being positioned between said gun body and said reservoir and having a lid releasably attached thereto and a pressure hose for directing said pressurized gas to said reservoir, said pressure hose being attached to said pressure regulator by a hose barb and said pressure hose being blown off said hose barb once said pressure inside said reservoir rises above a predetermined level, said pressure regulator including a diaphragm pressurized on one side by said gas exiting from said branch line and pressurized on another side by a spring member, said diaphragm acting upon a valve in said pressure regulator for opening or closing said branch line thereby controlling the pressure of said gas and said pressure of said pressure regulator being adjustable by an adjustment screw acting upon said spring, said reservoir having means for detaching said lid from said reservoir when said pressure in said reservoir rises above a predetermined level for releasing said gas from said reservoir when said pressure in said reservoir succeeds a predetermined level and said reservoir including securing members for holding said reservoir to said gun body upon detachment of said lid due to said over-pressure, said reservoir including an opening in said lid and a safety plug releasably held in said opening by friction, wherein an increase in pressure in said reservoir above a predetermined level increases said force acting upon said plug above said friction force pushing said plug out of said opening thereby allowing the compressed gas to escape, permitting an equivalent pressure reduction in said reservoir.

23. A low pressure spray gun for spraying liquid under pressure, said spray gun comprising a gun body having a spray nozzle, a reservoir for holding said liquid and releasably connected to said gun body and to a pressurized gas source, a pressure regulator for maintaining air pressure in said reservoir at a lower level than the pressure at said spray nozzle, said gun body having a material line connector for directing said liquid out of said reservoir through said spray nozzle and a gas line member for directing said gas through said gun body and said gas line member including a control valve for controlling said pressure of said gas through said gas line member and positioned between said source and said nozzle and a pressure-reducing throttle positioned between said valve and said nozzle, and a branch member releasably connected to said pressure regulator for directing said gas from said gas line to said pressure regulator, said pressure regulator being positioned between said gun body and said reservoir and having a lid releasably attached thereto and a pressure hose for directing said pressurized gas to said reservoir, said pressure hose being attached to said pressure regulator by a hose barb and said pressure hose being blown off said hose barb once said pressure inside said reservoir rises above a predetermined level, said pressure regulator including a diaphragm pressurized on one side by said gas exiting from said branch line and pressurized on another side by a spring member, said diaphragm acting upon a valve in said pressure regulator for opening or closing said branch line thereby controlling the pressure of said gas and said pressure of said pressure regulator being adjustable by an adjustment screw acting upon said spring, said reservoir having means for detaching said lid from said reservoir when said pressure in said reservoir rises above a predetermined level for releasing said gas from said reservoir when said pressure in said reservoir succeeds a predetermined level and said reservoir including securing members for holding said reservoir to said gun body upon detachment of said lid due to said over-pressure, said reservoir including an opening in said lid and a safety plug releasably held in said opening by friction, wherein an increase in pressure in said reservoir above a predetermined level increases said force acting upon said plug above said friction force pushing said plug out of said opening thereby allowing the compressed gas to escape, permitting an equivalent pressure reduction in said reservoir, said plug is releasably connected to said reservoir by a retaining member.

* * * * *

UNITED STATES PATENT AND TRADEMARK OFFICE

CERTIFICATE OF CORRECTION

PATENT NO. : 5,100,060

DATED : Mar. 31, 1992

INVENTOR(S) : Wolfgan Haferkorn

It is certified that error appears in the above-identified patent and that said Letters Patent is hereby corrected as shown below:

On the title page, insert the following:

--[30] Foreign Application Priority Data

May 7, 1990 [DE] Fed. Rep. of Germany.....9005155--.

Signed and Sealed this

Twenty-seventh Day of October, 1992

*Attest:*

DOUGLAS B. COMER

*Attesting Officer*

*Acting Commissioner of Patents and Trademarks*